US007430300B2

(12) United States Patent
Vosburgh et al.

(10) Patent No.: US 7,430,300 B2
(45) Date of Patent: Sep. 30, 2008

(54) SOUND PRODUCTION SYSTEMS AND METHODS FOR PROVIDING SOUND INSIDE A HEADGEAR UNIT

(75) Inventors: Frederick Vosburgh, Durham, NC (US); Walter C. Hernandez, Potomac, MD (US)

(73) Assignee: Digisenz LLC, Durham, NC (US)

( * ) Notice: Subject to any disclaimer, the term of this patent is extended or adjusted under 35 U.S.C. 154(b) by 830 days.

(21) Appl. No.: 10/715,123

(22) Filed: Nov. 17, 2003

(65) Prior Publication Data

US 2005/0117771 A1 Jun. 2, 2005

Related U.S. Application Data

(60) Provisional application No. 60/427,306, filed on Nov. 18, 2002.

(51) Int. Cl.
*H04R 25/00* (2006.01)

(52) U.S. Cl. ..... 381/376; 381/91; 381/74; 181/129; 2/423

(58) Field of Classification Search ..... 381/74, 381/333, 309, 310, 17, 301, 91, 92, 375, 381/376, 370; 425/2, 222; 2/423, 410, 209, 2/900; 623/10; 181/129, 126; 455/575.2
See application file for complete search history.

(56) References Cited

U.S. PATENT DOCUMENTS

| | | | | |
|---|---|---|---|---|
| 2,643,729 | A * | 6/1953 | McCracken | 181/242 |
| 4,308,426 | A * | 12/1981 | Kikuchi | 181/198 |
| 4,638,410 | A * | 1/1987 | Barker | 362/105 |
| 4,949,378 | A * | 8/1990 | Mammone | 380/276 |
| 5,073,936 | A * | 12/1991 | Gorike et al. | 381/26 |
| 5,691,514 | A * | 11/1997 | Landis | 181/129 |
| 6,101,256 | A * | 8/2000 | Steelman | 381/91 |
| 6,862,358 | B1 * | 3/2005 | Tabata | 381/301 |
| 6,978,159 | B2 * | 12/2005 | Feng et al. | 455/570 |
| 7,003,123 | B2 * | 2/2006 | Kanevsky et al. | 381/72 |
| 2001/0021257 | A1 * | 9/2001 | Ishii | 381/17 |
| 2004/0076301 | A1 * | 4/2004 | Algazi et al. | 381/17 |

* cited by examiner

*Primary Examiner*—Vivian Chin
*Assistant Examiner*—Jason Kurr
(74) *Attorney, Agent, or Firm*—Myers Bigel Sibley & Sajovec, PA

(57) ABSTRACT

Methods for generating a directional sound environment include providing a headgear unit having a plurality of microphones thereon. A sound signal is detected from the plurality of microphones. A transfer function is applied to the sound signal to provide a transformed sound signal, and the transformed sound signal provides an approximation of free field hearing sound at a subject's ear inside the headgear unit.

36 Claims, 8 Drawing Sheets

SOUND PRODUCTION SYSTEMS AND METHODS FOR PROVIDING SOUND INSIDE A HEADGEAR UNIT

RELATED APPLICATIONS

This application claims priority to U.S. Provisional Application Ser. No. 60/427,306, filed Nov. 18, 2002, the disclosure of which is hereby incorporated by reference in its entirety.

BACKGROUND OF THE INVENTION

1. Field of the Invention

The invention relates to systems and methods for producing sound inside a headgear unit, and more particularly to providing an approximation of free field hearing inside the headgear unit.

2. Background

Various types of headgear can be used in a variety of situations. For example, helmets can be used to protect a subject's head from injury during potentially dangerous physical activities, such as using a motor vehicle or participating in sports activities or military activities. In particular, military helmets can be used to protect a subject's head from injury as well as to provide a barrier against biological or chemical hazards.

However, headgear may also hinder the subject's perception of sound. Sound misperception or acoustic isolation can result in increased physical danger, for example, if a subject cannot hear spoken warnings or sounds from approaching objects. The interference between the headgear and external sound waves may result in the subject hearing sounds that are perceived as being muffled or softer than desired. It may also be difficult for a subject wearing a helmet to perceive the direction from which a sound is generated.

SUMMARY OF THE INVENTION

In some embodiments of the present invention, methods for generating a directional sound environment are provided. A headgear unit having a plurality of microphones thereon is provided. A sound signal is detected from the plurality of microphones. A transfer function is applied to the sound signal to provide a transformed sound signal, and the transformed sound signal provides an approximation of free field hearing sound at a subject's ear inside the headgear unit. Accordingly, a subject wearing the headgear unit may receive sounds from the outside environment despite sound interference from the headgear unit.

In other embodiments, methods for generating a directional sound environment include providing a plurality of headgear units, with each headgear unit having a plurality of microphones thereon. A sound signal is detected from the plurality of microphones on the plurality of headgear units. A transfer function is applied to the sound signal to provide a transformed sound signal so that the transformed sound signal provides an approximation of free field hearing sound at an ear inside at least one of the headgear units.

In further embodiments, a device for generating a directional sound environment includes a headgear unit and a pinna on an outer surface of the headgear unit. One or more microphones are provided so that at least one of the microphones are positioned adjacent the pinna. A speaker is positioned in an interior of the headgear unit. The microphone is configured to receive a sound signal and the speaker is configured to generate sound inside the headgear unit.

In some embodiments, a device for generating a directional sound environment includes a headgear unit having plurality of microphones thereon. The microphones are configured to detect sound signals. A processor in communication with the microphones is configured to apply a transfer function to a sound signal to provide a transformed sound signal. The transformed sound signal provides an approximation of free field hearing sound at a subject's ear inside the headgear unit. A speaker is positioned in the interior of the headgear unit and is configured to generate the transformed sound inside the headgear unit.

In other embodiments, a method for preparing a directional sound environment includes providing a plurality of sound sources at a first set of locations and a plurality of sound receivers at a second set of locations, the second set of locations being positioned on a headgear unit. A first set of sounds is generated at the plurality of sound sources. Sound signals are received at the plurality of sound receivers. The sound signals are result of sound propagation from the sound sources to the sound receivers. One or more of the received signals are identified to provide an approximation of the first set of sounds.

FIGURES

Figure 1:
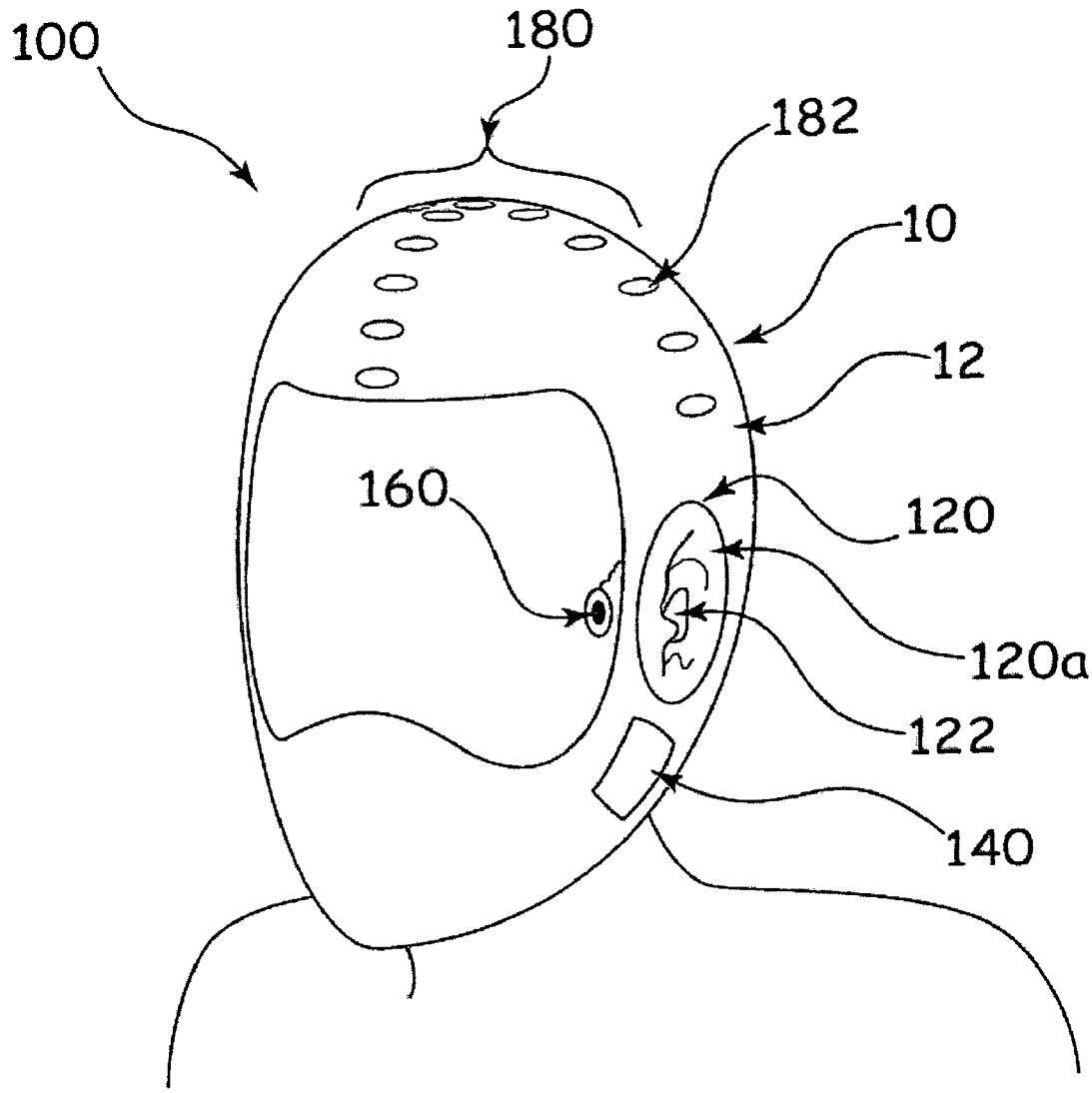
FIG. 1 is a perspective view of hearing systems in a helmet according to embodiments of the present invention.
Figure 3A:
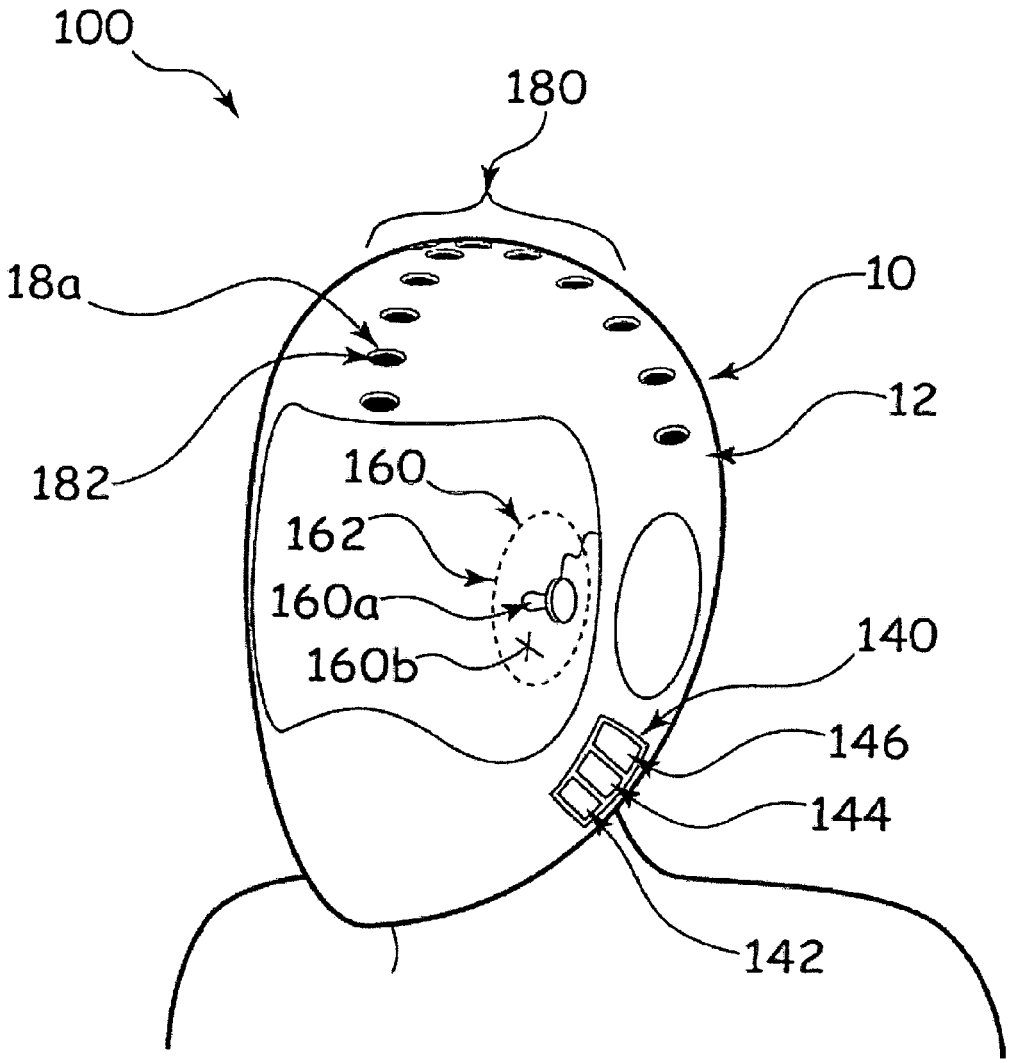

FIG. 3*a* is a more detailed perspective view of the hearing systems in the helmet of FIG. 1.

Figure 3B:
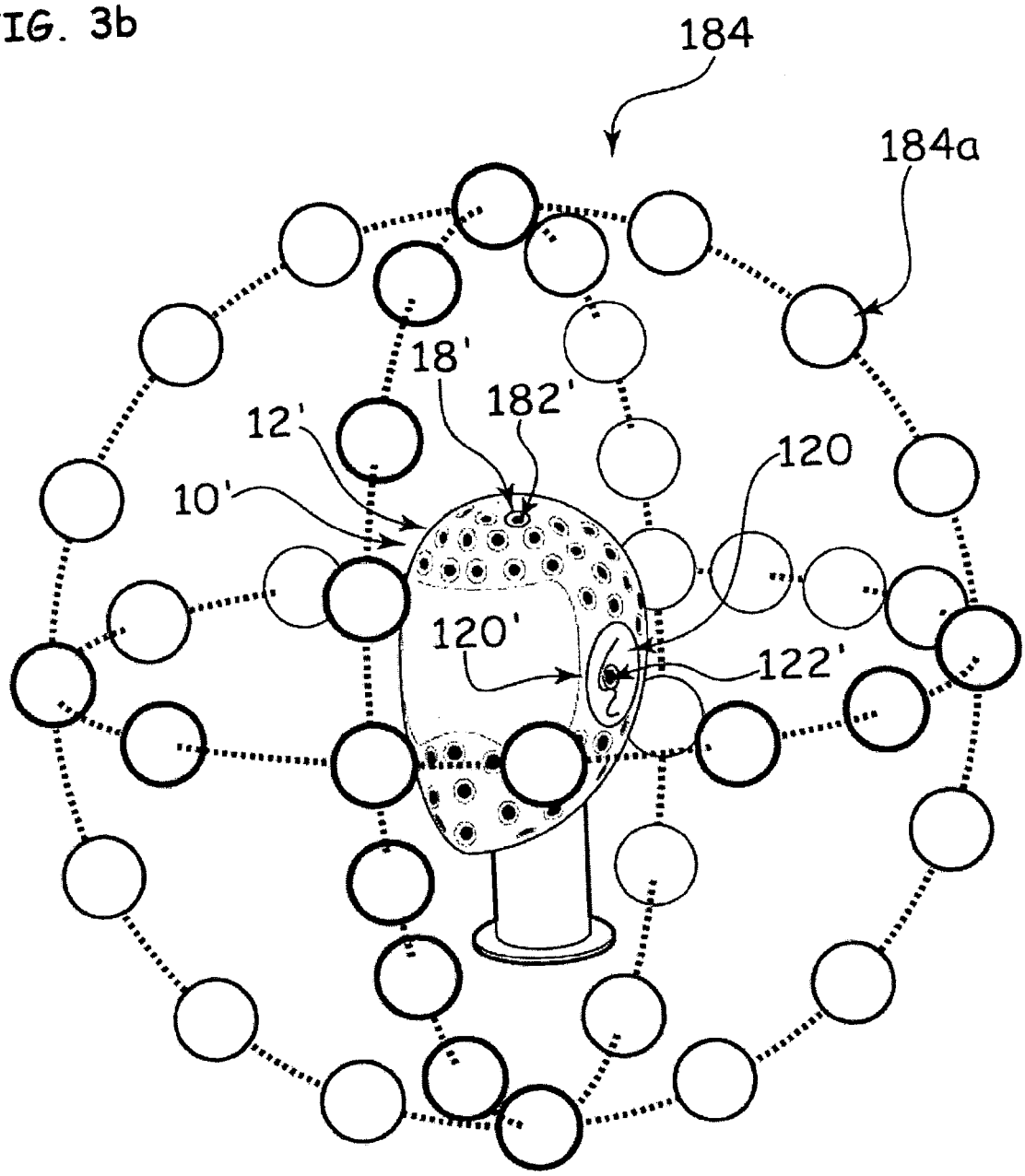

FIG. 3*b* is a schematic perspective view of a test helmet and test speakers used for preparation of a helmet according to embodiments of the present invention.

Figure 4A:
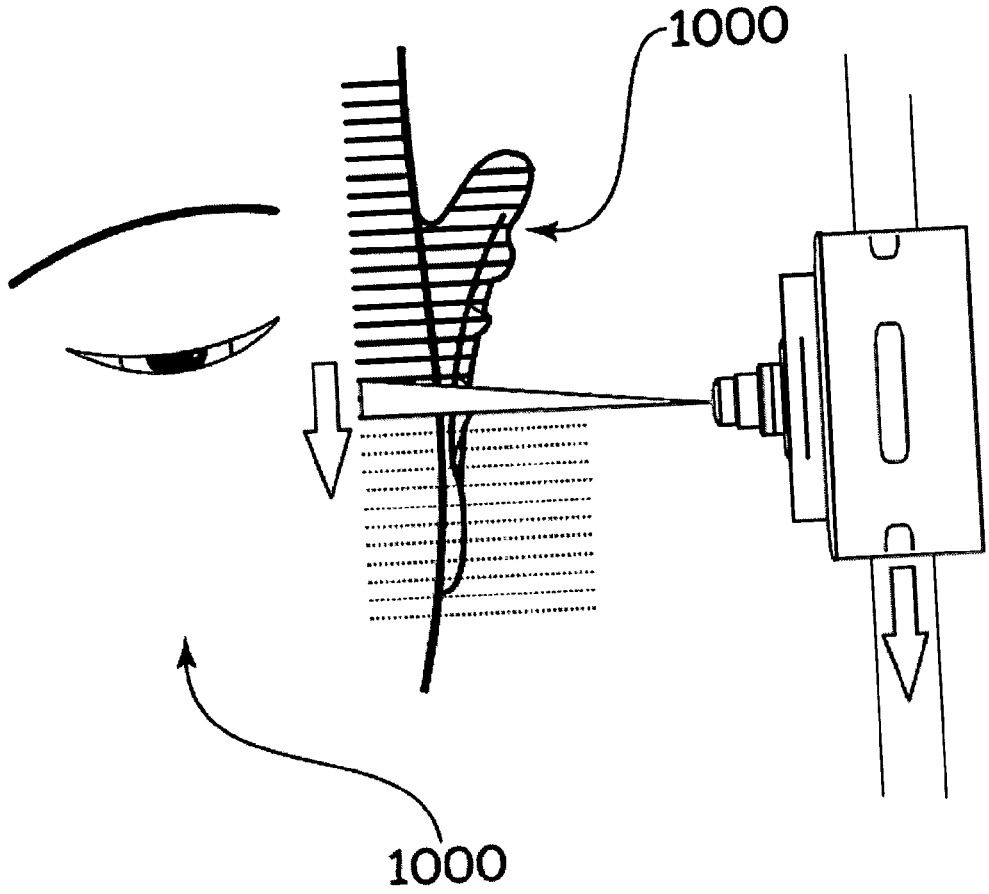

FIG. 4*a* is a perspective view of systems for scanning an individual user's ear for reproducing an individualized pinna according to embodiments of the present invention.

Figure 4B:
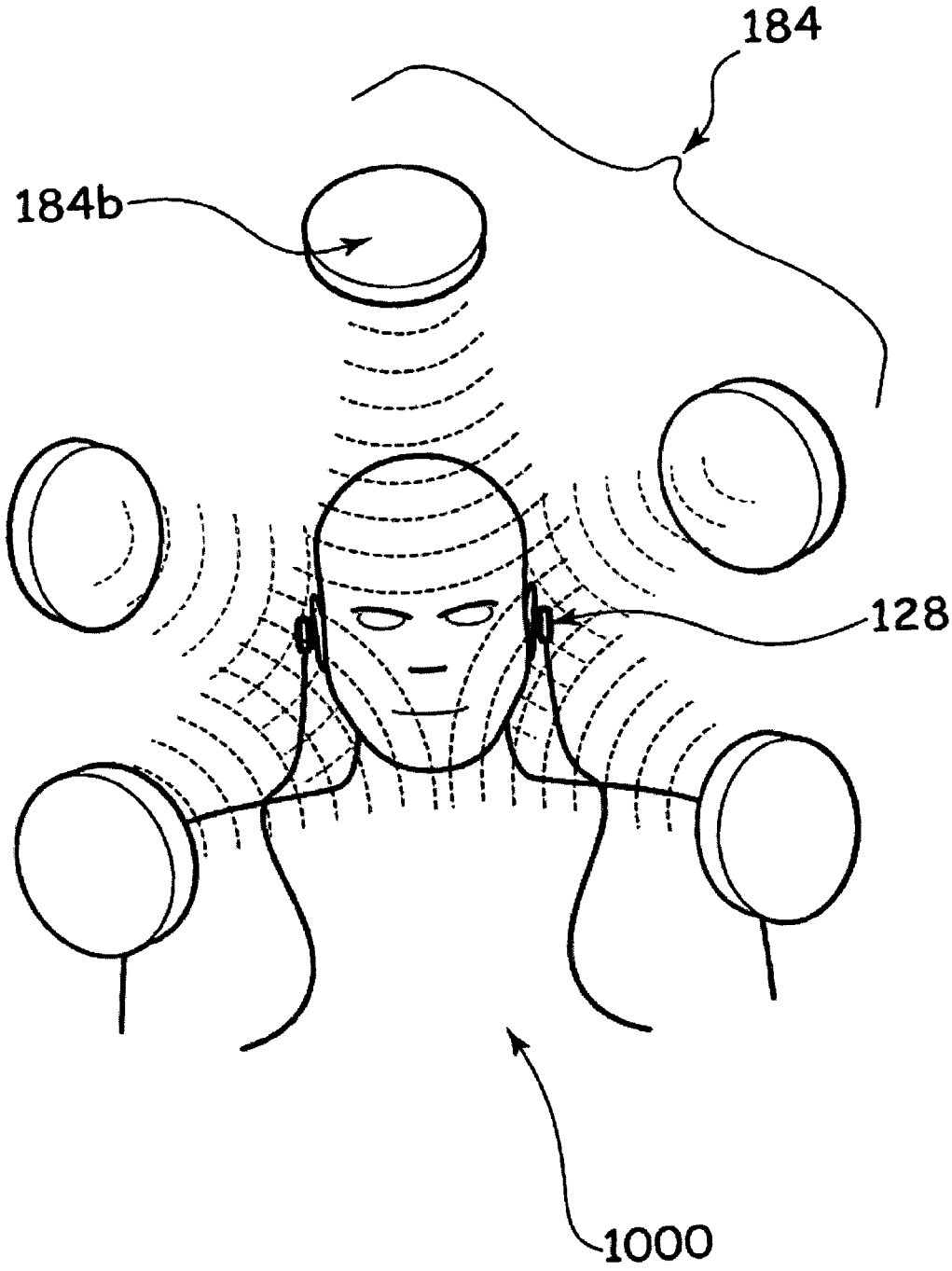

FIG. 4*b* is a perspective view of microphones and speaker systems for determining a transfer function according to embodiments of the present invention.

Figure 5:
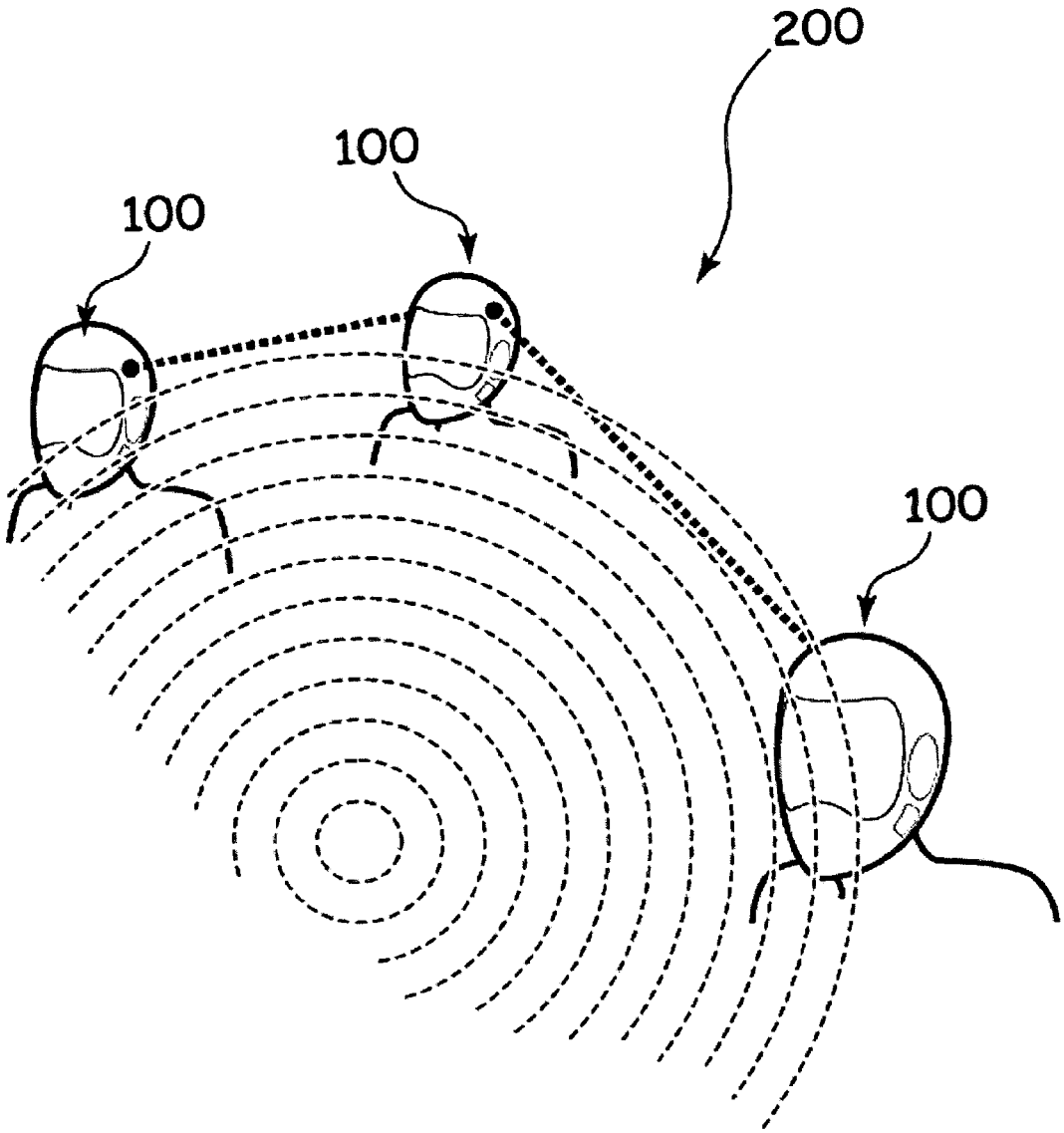

FIG. 5 is a perspective view of multi-helmet long baseline hearing systems according to embodiments of the present invention.

Figure 6:
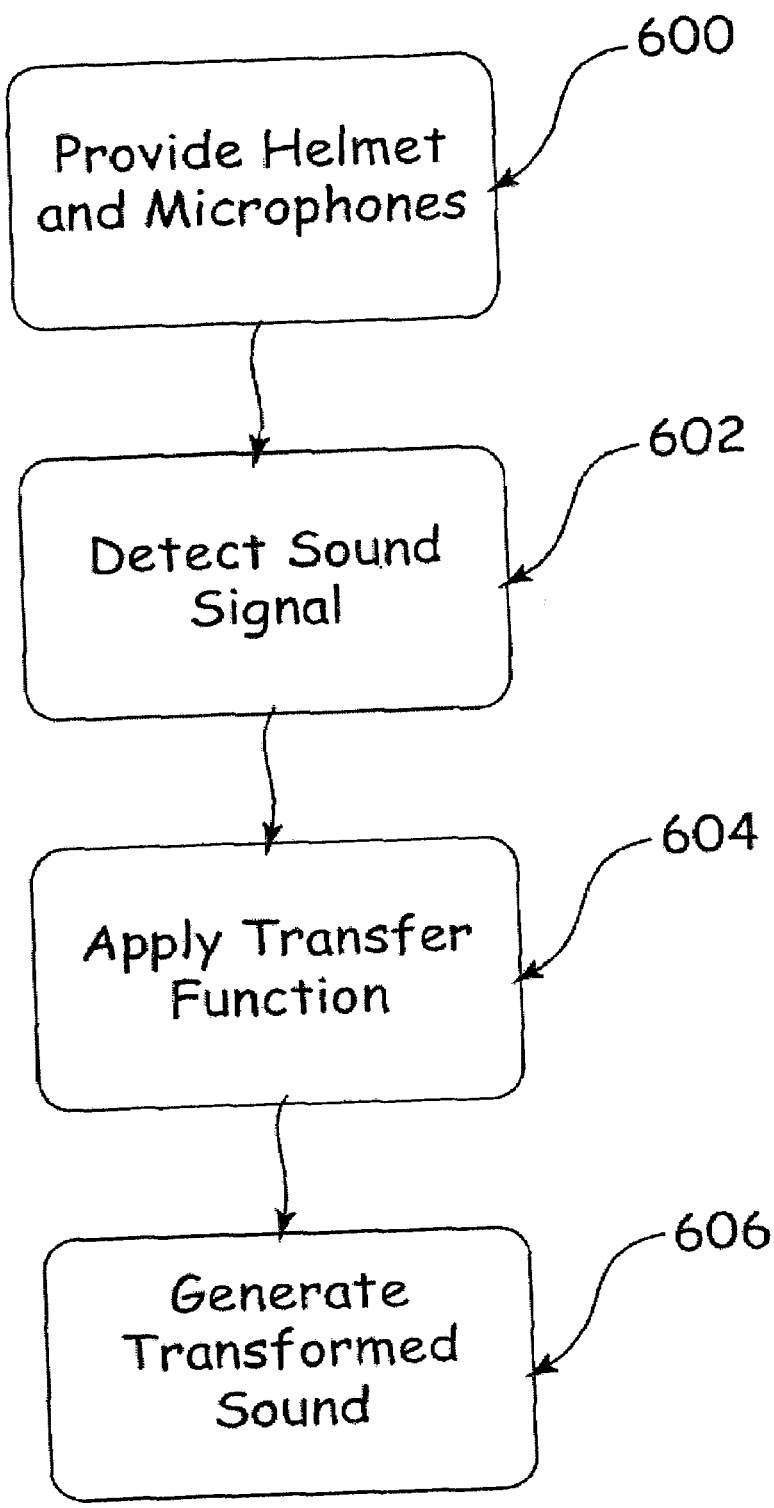

FIG. 6 is a flowchart illustrating operations according to embodiments of the present invention.

DETAILED DESRIPTION OF THE INVENTION

The present invention will now be described more particularly hereinafter with reference to the accompanying drawings, in which embodiments of the invention are shown. The invention, however, be embodied in many different forms and is not limited to the embodiments set forth herein; rather, these embodiments are provided so that the disclosure will fully convey the scope of the invention to those skilled in the art. Like numbers refer to like components throughout. Thicknesses and dimensions of some components may be exaggerated for clarity. When an element is described as being on another element, the element may be directly on the other element, or other elements may be interposed therebetween. In contrast, when an element is referred to as being "directly on" another element, there are no intervening elements present.

Embodiments of the present invention provide systems and methods for providing a directional sound environment, for example, inside a helmet. Other "natural" free field hearing characteristics may be approximated so that the sound propagation interference due to the helmet can be reduced or eliminated. For example, a sound signal can be detected from one or more microphones positioned on a helmet. A transfer function is then applied to the sound signal to provide a transformed sound signal. The transformed sound signal can provide an approximation of free field hearing at a subject's ear inside the helmet. For example, the transformed sound signal can be used to generate a sound inside the helmet that approximates the sound that the subject would hear if the sound were received at the ear substantially without interference effects from the helmet, i.e., as if the subject were not wearing a helmet. Other sound transfer functions may also be performed, including transfer functions to reduce or provide a canceling signal to cancel undesirable sounds. The transformed sound signal can also take into account localized reverberation and reflection effects. Accordingly, free field hearing characteristics may be simulated.

Although embodiments of the present invention are described herein with reference to helmet devices, other headgear units that may result in compromised hearing can be used, such as a helmet, headphones, a hat, or other physical obstruction to sound. For example, an encapsulated helmet having a natural hearing system attached to or integrated in the helmet can be provided. Helmets can include those worn by firefighting and rescue personnel, or civilians desiring the ability to detect, localize or understand sound they encounter while wearing a helmet. "Natural hearing" or "free field hearing" refers to sounds that approximate certain similar hearing cues to the sounds that the user would perceive naturally with the unaided ear when not wearing a helmet or other physical obstruction. "Natural hearing" includes various abilities, such as the ability to locate and identify sounds and understand speech as if the head were free of a helmet. For example, military battle gear may be sealed or encapsulated to protect the user against chemical and biological threats. However, encapsulating the head isolates the subject from the acoustic environment and, thereby, can create significant risks. Embodiments of the present invention may enable soldiers are to be protected from chemical and biological threats while maintaining "natural hearing".

Referring to FIG. 1, a helmet 10 is shown that includes a sound reproduction system 100. As shown in FIG. 1, the sound reproduction system 100 is an integrated part of the helmet 10. However, it should be understood that various components of the system 100 can be provided as a separate unit that can be mounted on, carried separately, or used together with the helmet 10. The system 100 can be used to provide hearing to subjects who are acoustically isolated or acoustically obstructed (in part or entirely) from the environment. For example, the helmet 10 can be substantially soundproof in a frequency range.

The system 100 includes two replica pinna 120 that can provide analog filtering, at least one microphone 122, a signal processing module 140 that can process microphone signals and other signals, and earphones 160 that can generate sound to the user, e.g., inside the helmet. It is noted that a second microphone and pinna (not shown) may be provided on the side of the helmet opposite the pinna 120 and microphone 122. As shown in FIG. 1, the system 100 includes an array 180 of ancillary microphones 182. It should be understood that various numbers of microphones 122 and 182 can be used and various microphone placements can be utilized. The helmet 10 has an outer surface 12, into which components of the system 100, such as microphones 122, can be mounted.

Figure 2:
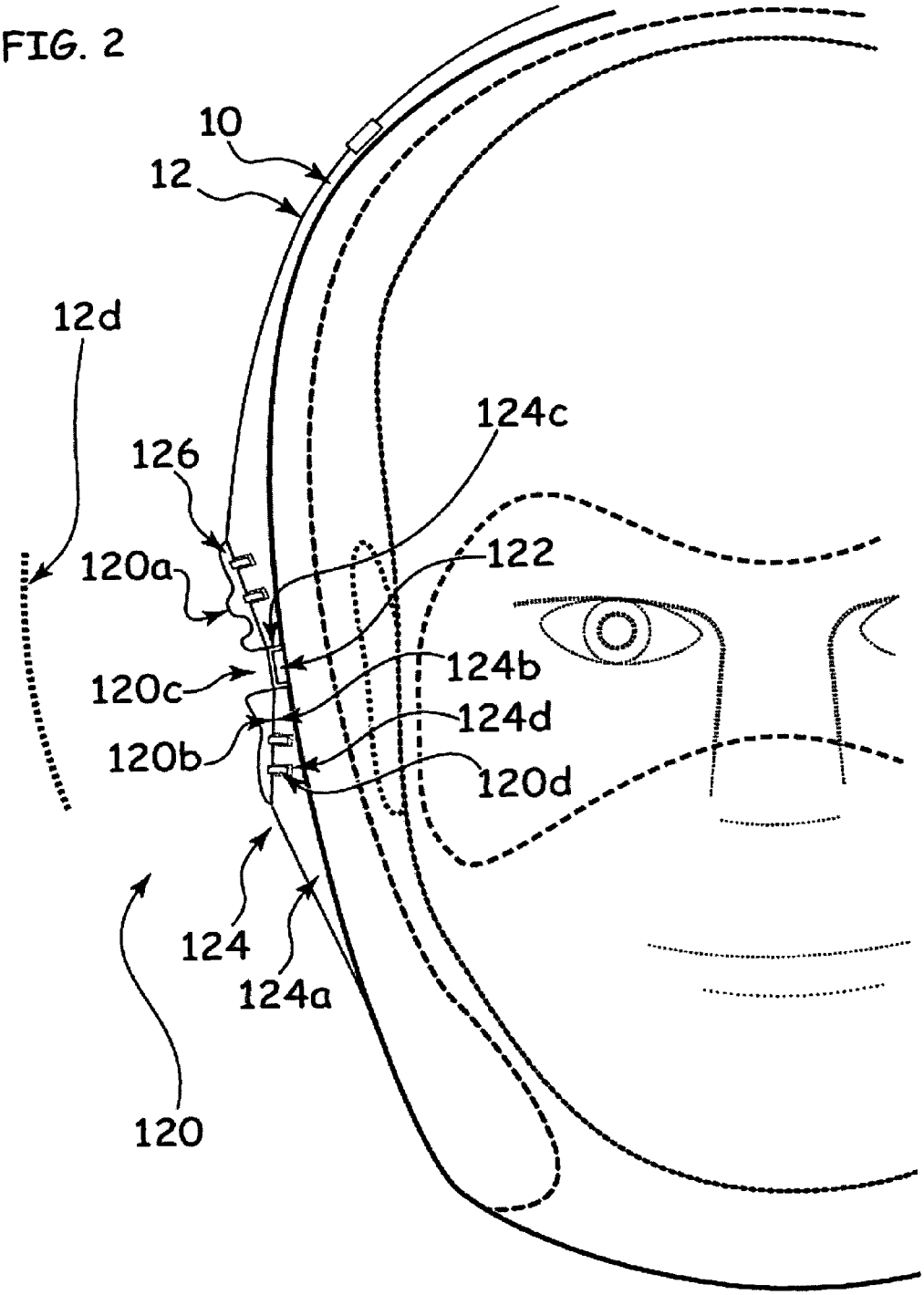
FIG. 2 is an enlarged partial front view of a pinna from the helmet in FIG. 1

Referring to FIG. 2, a pinna 120 includes a component having a filtering surface 120*a* that can resemble at least one anatomical feature of the outer human ear. As used herein, a pinna can be any shape designed to capture and/or reflect sound, such as a generally cup-shaped feature. While the pinna 120 can be shaped responsive to an average or standard ear, it may also be shaped responsive to an individual subject's ear. That is, an individualized pinna 120 can be shaped for a specific individual. The pinna 120 can include enhancing features, e.g., additional features including aspects that can be substituted for one or more external features of the outer ear, such as dimensionally modified representations of a helix, antihelix, crus of helix, cura of antihelix, tragus, antitragus, cavum conchae, or other departures from accurate reproduction of the ear. As illustrated in FIG. 2, the pinna 120 includes a first mounting surface 120*b*, a replica canal 120*c* and at least one anchor pin 120*d* or other securing component.

As shown in FIG. 2, a microphone mounting component 124 is provided. The microphone mounting component 124 includes a block 124*a*, a second mounting surface 124*b*, and an anchor pin receiver 124*d* for mounting the microphone 122. Other fastening mechanisms for mounting the microphone can be used. While the microphone 122, as illustrated, is mounted in the mounting block 124*a*, alternative configurations can also be used. For example, the microphone 122 can be mounted to a pinna 120 or the helmet 10.

The pinna 120 can be positioned at various locations on the outer surface 12 of the helmet 10. As illustrated, the location of the pinna 120 is externally adjacent the ear of the subject wearing the helmet 10. The surface of the pinna 120 includes recesses 126 (e.g., holes or depressions). The pinna 120 may be conformal or somewhat recessed or protuberant. The pinna 120 can be provided as a separate component that is mountable on the helmet 10. Alternatively, the pinna 120 can be formed as an integral part of the surface 12. The recesses 12*b* can be covered by a detachable and/or conformal curved screen 12*d*.

In this configuration, the pinna 120 can mimic or approximate the shape of a human ear. Sound received by the microphone 122 propagates into the pinna 120 in a similar manner that sound would be received by a human ear. The curved screen 12*d* can protect the pinna 120 while allowing sound to propagate through the screen and into the microphone 122. For example, the screen 12*d* can be formed of a material such as fabric, metallic, or plastic that is either woven, perforated or formed to provide a cover through which audible sounds may pass. Referring to FIG. 3*a*, the helmet 10 includes an integrated electronics module 140. Although the electronics module 140 as shown is an integral part of the helmet 10, the electronics module 140 can be provided as a separate unit. For example, the electronics module 140 can communicate with the microphones 122 (shown in FIGS. 1-2), 182 and/or the speaker 160 via wired or wireless communications. The electronics module 140 could also be carried by the user or provided as part of a communications system. The electronics module 140 controls various operations of the microphones 122 and the speaker 160, such as to receive sound signals from the microphones 122, 182 and send sound signals to the speaker 160. The electronics module 140 can also provide various processing operations. For example, the electronics module 140 can apply a transfer function to sound signals to modify the signals. As illustrated, the electronics module 140 includes a signal converter 142, a digital signal processor unit 144, and a signal output module 146. The signal converter 142 can include a signal conditioner module and/or a digital sampler. The converter 142 can include a plurality of signal inputs and/or a multiplexer for processing various signals received from the microphones 122, 182. The processor unit 144 can include digital processing and memory modules/circuits and/or digital inputs. The signal output module 146 can include an analog signal producer, an amplifier, at least one signal output connection and/or a multiplexer. For example, an output connection can provide a signal to the earphones 160 via a conductor (such as an electrical wire, an optical fiber, or a wireless transmitter).

Although embodiments of the invention are described with reference to the electronics module 140 and the signal converter 142, digital signal processor unit 144, and signal output module 146, other configurations are possible. For example, portions of the signal output module 146 can be incorporated into the headphones 160. The headphones 160 may be digital headphones and can include a wireless circuit, an analog signal producer, and amplifier similar to those described for the signal output module 146.

The electronics module 140 can perform various functions according to embodiments of the invention. For example, as shown in FIG. 6, a helmet, such as helmet 10 in FIGS. 1, 2 and 3*a*, can be provided having a plurality of microphones thereon (Block 600). A sound signal can be detected by the microphones 122, 182 (Block 602). A transfer function may be applied by the electronics module 140 to the received sound signal to provide a transformed sound (Block 604). The transformed sound can provide an approximation of free field hearing sound at an ear inside the helmet. Sound responsive to the transformed sound signal can be generated inside the helmet (Block 606) by the speaker 160. The transfer function may be based on an experimentally determined propagation effect from sound propagating to an opening of an ear canal and substantially omitting propagation interference from the helmet. The transfer function can also selectively reduce component(s) of relatively large amplitude or otherwise undesirable sounds or provide a cancellation signal to cancel the amplitude of selected sounds.

Although the above operations are described with respect to the helmet 10 shown in FIGS. 1, 2, and 3*a*, other configurations of headgear and/or electronic modules can be used, including variously shaped headgear units and other electronics modules capable of performing operations according to embodiments of the invention.

With reference to FIG. 3*a*, the earphones 160 include in-ear portions 160*a* and in-helmet speakers 162. It should be noted that various types of output devices can be used, such as ear phones that rest on the ear, cover the ear, or other speaker configurations that are proximate to the ear. In addition, a single speaker can be used, e.g., either the earphones 160 or the in-helmet speakers 162. In the configuration shown, the earphones 160 have a moldable material 160*b* for enhanced fit. The earphones 160 can include a power source, such as a battery, and a wireless communications component for communication with the electronics module 140.

As shown, the system 100 includes an array 180 of ancillary microphones 182. Various configurations of arrays, such as array 180, can be employed. For example, the array 180 can include between 0 and 60 ancillary microphones 182. In some embodiments, about 5 to about 10 microphones are provided on the helmet. Positions for the microphones 182 can be selected to increase the amount sound information received by the microphones 182. For example, the microphones 182 can be spaced out along the surface of the helmet 10 in order to receive sound from various directions. As shown, the microphones 182 form a generally cruciform shape. However, other shapes and configurations can be used, such as circular shapes, concentric circles and configurations that space apart the microphones to receive sounds from multiple directions. Various methods for selecting the positions of the microphones are discussed in greater detail below. As shown in FIG. 3*a*, the microphones 182 are positioned in depressions 18*a* for housing the microphone 182 in a flush or conformal configuration. In this configuration, the depressions 18*a* can protect the microphones 182 from the environment.

In some embodiments, the helmet 10 can be prepared by selecting desirable locations for the microphones 122, 182 and/or by customizing various features for an individual user. For example, a microphone array structure (such as array 180) can be selected to provide a desired level of acuity, precision, or sensitivity of one or more aspects of natural hearing. For example, one microphone can be provided on the front, back, and each side of the helmet to provide a sound receiver in several directions. Aspects of natural hearing can include sound detection, sound localization, sound classification, sound identification, and sound intelligibility.

Referring to FIG. 3*b*, an exemplary system for testing and/or selecting the placement of microphones 182' on a helmet 10' using an array 184 of test speakers 184*a* is shown. The number of microphones 182' can be between about 0 and about 50, or between about 2 and about 32, although other microphone numbers and configurations can be used.

The test speakers 184*a* are positioned at various locations around the helmet 10'. In this configuration, the test speakers 184*a* can provide sound from multiple directions. Each of the microphones 182' receives a sound signal that results from the sound propagation from the speakers 184*a* to the microphones 182'. The sound signal received by the microphones 182' can be distorted due to interference from the helmet 10'. For example, one of the microphones 182' on one side of the helmet 10' may receive sound propagating from one of the speakers 184*a* positioned proximate the microphone 182' with less interference compared to one of the speakers 184*a* positioned on the other side of the helmet 10'. Accordingly, each of the microphones 182' receives a sound signal that reflects the particular sound propagation to the location of the microphone 182'. The received signals can then be processed to determine optimal locations for the microphones 182'. For example, the received signals can be combined and duplicative information from the microphones 182' can be identified. Microphones can be selected that provide an approximation of the combined signal. The locations of the microphones may be optimal or preferred locations for a subset of the microphones 182'. Helmets can then be manufactured using the experimentally determined preferred locations. In some embodiments, a transfer function can be determined that represents the differences between the sound generated by the speakers 184*a* and the sounds received at the microphones 182'. The transfer function can be used to identify one or more of the received signals and/or to modify to the received signals to provide an approximation of the sounds generated by the speakers 184*a* and/or an approximation of free field hearing. The placement of the microphones 182' in an array structure can be selected using various methods to determine a subset of microphones that provide sufficient information to reproduce an approximation of the sound from the speakers 182'. For example genetic algorithm techniques, physical modeling, numerical modeling, statistical inference, and neural network processing techniques can be used.

As one specific example, the genetic algorithm technique can include forming a basis vector responsive to propagation effects on sound propagating from a plurality of test sound locations. A basis vector can include transfer function coefficients for microphones in the array structure. The basis vector can be responsive to propagation effects of the anatomy of the user, for example, the head and/or ears, as well as to effects of the microphones on a helmet. The basis vector can include coefficients representative of all detected propagation effects; however, some of the propagation effects and/or coefficients of the basis vector can be omitted to provide a simplified basis vector.

The basis vector is related to the head related transfer functions (HRTF) used in characterizing the propagation effects of an individual's anatomy in an environment, such as an anechoic environment. That is, the HRTF characterizes the propagation effects as a subject would receive sound without the helmet. The relationship between an emitted sound and the detected sound can be represented as;

$$V(t)=H_i*S_i(t) \quad (1)$$

where $S_j(t)$ can represent sound sound at time t emanating from a given location, e.g. a $j^{th}$ location. $H_i$ can represent the HRTF for sound propagation associated with the $j^{th}$ location. V(t) represents the sound detected, typically with in-ear microphones, in the ear at time t when the subject is not wearing the helmet, for example, as shown in FIG. 4*b*. An HRTF may be calculated for each of j speakers, such as speakers 184*b*, as shown in FIG. 4*b*, placed around a subject 1000 using ear microphones 128, and can include a plurality of coefficients as described above.

In some embodiments, an HRTF can be substituted with a convolved transfer function, $B_j$ which can include a convolution of head, helmet, and microphone transfer functions and thereby represent the aggregate effect HRTF, helmet-related effects, microphone effects, and earphone effects. Processing according to $B_j$ can provide sound from an earphone that is desirably responsive to the intial $S_j(t)$.

The basis vector for a plurality of microphones can include coefficients representative of helmet, microphone, and earphone effects for a plurality of microphones various locations, in addition to the HRTF for an individual user, as represented by convolution of the component transfer functions. For example, equation (1) can be re-written in terms of $B_j$ and for i microphones, as:

$$V(t)=\sum_i Bj(t)*Sj(t) \quad (2)$$

In certain embodiments, a basis vector can include independent sets of coefficients. For example, a basis vector can include an aggregate set of coefficients minus coefficients providing substantially redundant information. A basis vector can include redundant information, which can provide for robust function of the system.

The number of spatial locations for the microphones or an equivalent number of array microphones can reflect the range of wavelengths for which computational transformation is desired. For example, a microphone placed near a pinna can include coefficients responsive to wavelengths on the order of and greater than the dimensions of the ear, although shorter wavelengths are also acceptable.

The spacing and locations of the microphones can be determined by detecting microphone signals as the basis for determining the helmet, microphone and earphone components of $B_j$ or alternatively $B_j$, for test sounds emitted from a set of test speakers, such as the test speakers 184*a* in FIG. 3*b*. The test speakers 184*a* can be positioned in the far field, for example, more or less radially from the center of the head on a line passing through the location of a microphone 182', although other spacing configurations can be used. For example, the test speakers 184*a* may be spaced so that the speakers 184*a* are more or less even. The speakers 184*a* can be spaced responsive to psychoacoustics such as front-back ambiguities. Other non-uniform spacing can also be used.

In some embodiments, a helmet can be prepared by determining a number and location of microphones according to the techniques described above. For example, the locations of microphones providing a relatively large amount of information to the basis vector compared to other microphones can be selected. It should be noted that test speaker and/or microphone locations can be changed from time to time, or can depart from the specified locations provided that the spacing is sufficient to provide sounds that can be perceived as coming from different locations.

The genetic algorithm technique can further include selecting among a plurality of reduced basis vectors. A "reduced basis vector" refers to a basis vector that includes a subset, or reduced set, of basis vector coefficients. A reduced basis vector can provide a simplification of the basis vector to approximate the basis vector and reduce complexities and/or signal processing demands. For example, a reduced basis vector can include coefficients for between about 2 and about 25 selected microphones out of a total of 60 microphones on the test helmet 10*a* in FIG. 3*b*. These selected microphones can be used to determine the preferred locations of microphones for the helmet. Other numbers of selected microphones or test microphones are also acceptable. As another example, the basis vector can be reduced based on the wavelengths of the desired sound. For example, a reduced basis vector can include coefficients for sound having wavelengths between 5 cm and 50 cm, although other ranges are acceptable.

Moreover, various array structures and/or reduced basis vectors can be selected based on the amount of information necessary to reproduce a sound with sufficient precision. Selecting a reduced basis vector and/or an array structure for a helmet model can include determining a reduced basis vector that provides the desired level of hearing and/or other desirable characteristic, such as the number or locations of the microphones. Selecting a basis vector and array structure for a helmet can be performed for a specific helmet and/or individual subject. Alternatively, the basis vector and array structure may be selected for a model of a helmet and subsequently applied to other helmets. A model can be characterized by substantially consistent acoustic propagation effects, e.g., dimensions, shape, material properties, and/or exterior protuberances.

In some embodiments, the physics of spatial sampling can be the basis for estimating the number of locations for the microphones 182' in FIG. 3*b*. For example, assuming that the sound waves of interest are larger than the ear and smaller than the head, spatial sampling according to the Nyquist criterion may dictate spacing between ancillary microphones 182' that is between 3 and 15 cm, which translates into between 3 and 30 locations on a helmet 10' modeled as a hemisphere 30 cm in diameter. Wave sizes between the size of the head and the ear are affected primarily by anatomical or other object features of approximately that size. On the other hand, shorter waves are affected by the filtering surface 122' of the pinna 120' while larger waves are affected only by torso features and head-sized or large objects in the environment.

For example, D. J. Kistler and F. L. Wightman (vide ante) indicate that a number of HRTF features as low as five can be used to provide good fidelity in reproduced sound. Fidelity in this context refers to the fraction of HRTF information that is successfully reproduced. N. Cheung, S. Trautmann & A. Horner in 1998 reported results with similar implication in "Head-related transfer function modeling in 3D sound systems with genetic algorithms." (*J. Audio Engr Soc* vol. 46, preprint) (hereinafter "Cheung et al."). Cheung et al. found HRTF files based on 710 emitter locations in the standard KEMAR database can be compressed 98%. This is equivalent to requiring only 14 source speakers. Information theory indicates that the degrees of freedom for the microphone locations may be equivalent to that for the source count. Therefore, the results of Cheung et al can be used to estimate that 14 microphone locations may produce equivalent levels of fidelity.

A desired reduced basis vector can be selected by measuring or ranking coherence for a plurality of reduced basis vectors and selecting one that provides a desired level of coherence. Coherence can, for example, be measured by calculations using a coherence measure between a sound V(t) responsive to a reduced basis vector and V(t) for a full basis vector or the emitted sounds S(t). It should be noted that transformation with a full basis vector, i.e. responsive to signals detected with all test microphones, can represent high fidelity transformation and, therefore, complete or near complete coherence. A reduced basis vector can represent reduced coherence. A reduced basis vector can be selected based on a desired level of coherence and/or other characteristics such as the least number of microphones or at least one specific location (such as over the ear of the subject).

In certain embodiments, the array structure (e.g., the number or locations of the microphones) can be classified at a relatively high level of importance, and coherence can be classified as being of secondary importance. Coherence can be achieved with a higher number of microphones than can be achieved when the location is not a primary constraint. A desired basis vector can be determined by ranking a plurality of alternative basis vectors according to the degree of fidelity and the number of array microphones. The basis vector representing the desired level of fidelity and lowest number of array microphones can then be selected.

In some embodiments, the selection of a basis vector can be responsive to a desired level of array microphone redundancy in determining V(t). For example, the selection of a basis vector can include selecting the number and the locations of the microphones. The locations of the microphones can also be determined by alternative approaches such as physical modeling, closed form solution, numerical approximation, neural net, or statistical inference. In the some embodiments, a prepared system, helmet, or helmet model can then be individualized for the user.

In some embodiments, the system can be individualized by creating individualized pinna and individualized transfer functions, $B_j$. Individualization of the pinna may include producing a replica of the outer ear for the individual subject. Individualized transfer functions can be determined by processing signals recorded for the individual user using in-ear microphones in the presence of $B_j$-determining sounds.

Production of individualized pinna can be conducted by various methods including industrial rapid prototyping methods, computer aided design and engineering, casting, medical prosthetic fabrication, or computerized sculpture methods. In certain embodiments, rapid prototyping methods and equipment may be used. As shown in FIG. 4*a*, the production of a pinna can include the measurement of the ears 1010 of a subject 1000 by optical scan, although other interferometer methods or three-dimensional or digital photography are acceptable. Optical scanning may be conducted with laser light, although incoherent or wideband light sources can be used. A digital scanning file then is used to control equipment producing a replica of the scanned ear. The replica can be a molded, bonded, sintered, laid up, or machined object. Materials can include urethanes, or filled or reinforced polymers having elastic and/or acoustic properties similar to cartilage, although other plastics, metals, glasses, protein, and cellulose products are also acceptable.

Referring to FIG. 4*b*, an individualized transfer function can be determined by processing signals recorded from in-ear individualizing microphones 128 worn by the individual subject 1000 during a recording session while sounds used to determine the transfer function are emitted from a set of speakers 184*b*. The number of speakers 184*b* can include a subset of test speakers 184*a* (in FIG. 3*b*) although more or fewer speakers can be used. For example, additional individualizing speakers 184*b* can be used to provide redundant information or fewer can be used, based on the acceptable or desired level of fidelity. The results of processing may be further processed by convolution with a helmet calibration determined as described below. In some embodiments, an individualized transfer function is formed for each pinna microphone 124 and each ancillary microphone 182.

Referring again to FIG. 3*b*, a helmet calibration may be determined once for a helmet 10 having a certain model shape. The calibration can then be applied other helmets to of the same model. Calibration may then be conducted by a similar process as used to determine the transfer function except signals are recorded with pinna microphones 124 and ancillary microphones 182 rather than in-ear microphones in a procedure that does not require the presence of the individual user. For example, the helmet can be mounted on a dummy, mannequin, or fixture, although it can also be worn by the individual user or a testing person.

Sounds generated for determining the transfer function can be selected for a frequency range. An exemplary frequency range includes frequencies affected by the size and shape of the head, although other frequency ranges can be used. This can be expressed alternatively as frequencies too long to be significantly affected by ear anatomy and shorter than those affected by torso-scale or larger features of the environment. Examples of standard ranges that can be used include ranges between about 10 and 5,000 Hz, between about 100 and 3,500 Hz, or between about 250 and 2,500 Hz, or between about 20 and 20,000 Hz.

In some embodiments, collecting signals for determining a transfer function and scanning the ear for pinna individualization can be conducted simultaneously. For example data can be gathered while a user is seated at a station that includes a chin or head rest that can stabilize the head. Once the data has been gathered, transfer functions can be calculated and loaded in memory in the system 100 shown in FIG. 3*a* and the individualized pinna 120 can be formed and mounted. Individualization of the helmet can be conducted at the time of induction or battle-gear issuance.

Referring to FIGS. 1, 2 and 3*a*, the system 100 can be used so that a subject perceives sound in the environment outside the helmet by generating sound using sound signals received by the microphone, applying a transfer function, and generating the transformed sound signal. The perceived sound may enable various characteristics of natural hearing, such as cues responsive to source localization, cues related to sound classification, identification, separation, and, for spoken words, speech intelligibility. The subject can also use the system 100 to receive natural or derived hearing cues. The sounds generated by the speaker 160 can also include selectively produced sounds or selectively ignored sound from the signals received by the microphones 180. Hearing cues can include features of perceived sound that provide the user information regarding, location, type, class, identity, and other characteristics of a desirably heard sound. Natural cues can include differences in arrival time, loudness, and spectral content.

Derived cues can include the results of signal modifying or combining, and can include modulated natural cues or synthetic cues. For example, the system 100 may be in communication with other systems to provide communications such as radio communications between subjects wearing the helmets 10. An example of a synthetic cue is a computerized voice warning of an object moving overhead and/or verbally identifying the object. An example of a modulated natural cue is the sound of a vehicle on a hillside where the sound is modulated in proportion to angle of inclination. Other enhancements/modifications can be provided. For example, speech intelligibility may be enhanced using methods known in the art, such as source separation methods such as beam forming.

The acuity of the human ear may not be responsive to certain achievable levels of fidelity in a reproduced sound. Therefore, the determination of the locations and count of the microphones 180 may be responsive to natural hearing acuity rather than achievable levels of fidelity. One procedure for determining the locations of the microphones includes selecting a least one basis vector that provides a desirable level of acuity with the fewest locations. While the smallest microphone count that provides a desired acuity may reduce processing demands and/or reduce manufacturing costs, other basis vectors or microphone counts can be used. For example, a basis vector representing a greater number of locations can be selected to better provide for other aspects of helmet design, such as locating other helmet components. In certain applications, a basis vector providing reduced acuity can also be selected if fewer microphones are acceptable to achieve a desirable reduction in power or computational demands on the system.

The system 100 can be used to provide sound to a user. In certain embodiments, the sound can be processed, individualized, natural, or enhanced. As shown in FIGS. 1 and 2, the filtering surface 120*a* can be used as an analog filter to provide filtered sound. Filtered sound can be detected using at least one microphone 122. In addition, sound can be detected with at least one ancillary microphone 180. In certain embodiments, other data can be determined, such as helmet location and a time of signal detecting, such as provided by a time stamp.

Cues can be perceived related to sound detection, localization, separation, or identification. Enhanced cues can be perceived related to sound localization, separation, and/or identification. Intelligibility or enhanced intelligibility of speech can be provided. Intelligibility can be provided together with selective amplification or attenuation of one or more sounds or with modulation or other methods to enhance cues.

Sound signals that can be enhanced to provide enhanced sound include verbal cues, such as a synthesized voice providing identification or the localization of a sound. Enhanced cues can include modulated sound so that the modulation conveys information regarding a sound, such as a readily detectable amplitude modulation having a frequency, or warble, proportional to the angular elevation of the location of a sound source.

The sound signals can be processed by coherent processing or multi-sensor processing. Coherent processing can be used in certain embodiments to selectively enhance or selective attenuate one or more sounds. For example, beam steering can be used to isolate and selectively amplify a voice while selectively attenuating a masking noise from another source, such as a noisy nearby vehicle.

Referring to FIG. 5, coherent processing can be processed by processing signals from more than one system 100 to provide an extended baseline listening system 200. Accordingly, enhanced detection, localization, classification, or identification of sound, or enhanced intelligibility of speech can be provided. For example, signals can be processed indicative of the relative position of the systems 100. An example is a GPS signal for, or a range and bearing between, systems being used to form an extended baseline listening system 200. Extended baseline processing can further include processing time stamp signals to enhance the coherence of the processing.

In some applications, undesirable sounds may penetrate the helmet. For example, loud noises at relatively long wavelengths, e.g., longer than the dimensions of the helmet, may be heard inside a helmet without being reproduced by a speaker inside the helmet. In some applications, loud noises, such as battlefield blasts or engine sounds, may cause hearing loss or reduce the ability of the subject to perceive other sounds. In some embodiments of the present invention, hearing protection may also be provided. Hearing protection can include attenuating, compressing, or canceling sound that is undesirably intense. Attenuation can include filtering or clipping signals. "Clipping signals" refers to failing to detect amplitude values greater than a desired magnitude with the result that a time record signal can have a flat portion where the amplitude of the detected signal is "clipped" or constant despite the actual signal having a greater magnitude. Attenuation without clipping can include amplitude compression so that the amplitude is increasingly attenuated as it further exceeds a desirable threshold. For example, the amplitude sound above 80 dB can be multiplied by factor having an exponent inversely proportional to the magnitude by which the threshold is exceeded. Amplitude compression can be provided by analog or digital components. Projecting antiphase sound to cancel an undesirable loud sound as it reaches the user's ear, for example, using in-helmet speakers 160 as shown in FIG. 3*a*, can provide active noise canceling. Canceling, like amplitude compression, can be increased in proportion to the loudness of a sound above a desired threshold. In certain embodiments, filtering, amplitude compression, and active noise canceling can be practiced together.

The foregoing embodiments are illustrative of the present invention, and are not to be construed as limiting thereof. The invention is defined by the following claims, with equivalents of the claims to be included therein.

That which is claimed:

1. A device for generating a directional sound environment, the device comprising:

a headgear unit;

a pinna on an outer surface of the headgear unit, wherein the pinna approximates the shape of a human pinna;

a microphone positioned adjacent the pinna; and a speaker positioned in an interior of the headgear unit, wherein the microphone is configured to receive a sound signal and the speaker is configured to generate sound inside the headgear unit;

wherein the pinna has a filtering surface and serves as an analog filter to provide filtered sound to the microphone, the filtered sound being a representation of natural hearing approximating hearing cues a wearer of the headgear unit would receive naturally with the unaided ear when not wearing the headgear unit.

2. The device of claim 1, wherein the device further comprises a processor configured to apply a transfer function to the received sound signal to provide a transformed sound signal, the transformed sound signal providing an approximation of free field hearing sound at a subject's ear inside the headgear unit.

3. The device of claim 2, wherein the transfer function is based on an experimentally determined propagation effect from sound propagating to an opening of an ear canal and substantially omitting propagation interference from the headgear unit.

4. The device of claim 2, including a plurality of microphones positioned at locations on the headgear unit, the locations being selected to provide sufficient sound information to provide an approximation of free field hearing sound.

5. The device of claim 2, wherein the processor is further configured to reduce an amplitude of a portion of the sound signal if the amplitude is higher than a threshold level.

6. The device of claim 2, wherein the processor is further configured to cancel the amplitude of a portion of the sound signal.

7. The device of claim 2, wherein the headgear unit comprises a helmet.

8. The device of claim 2, wherein the processor is further configured to cancel the amplitude of selected sound signals.

9. The device of claim 1, wherein the headgear unit is substantially sound-proof in a frequency range.

10. The device of claim 1, wherein the pinna has the shape of a human ear.

11. The device of claim 1, including an earphone including an in-ear portion, wherein the speaker is configured to generate sound through the in-ear portion.

12. The device of claim 1, wherein the pinna approximates the shape of an average human ear.

13. The device of claim 1, wherein the pinna approximates the shape of an ear of an individual intended to wear the headgear unit.

14. The device of claim 13, including an earphone including an in-ear portion, wherein the speaker is configured to generate sound through the in-ear portion.

15. The device of claim 1, including an earphone including an in-ear portion, wherein the speaker is configured to generate sound through the in-ear portion.

16. The device of claim 1 further including:

a second pinna on the outer surface of the headgear unit opposite the first pinna, wherein the second pinna approximates the shape of a human pinna;

a second microphone positioned adjacent the second pinna; and a second speaker positioned in the interior of the headgear unit, wherein the second microphone is configured to receive a sound signal and the second speaker is configured to generate sound inside the headgear unit;

wherein the second pinna has a filtering surface and serves as an analog filter to provide filtered sound to the second microphone, the filtered sound being a representation of natural hearing approximating hearing cues a wearer of the headgear unit would receive naturally with the unaided ear when not wearing the headgear unit.

17. A method for generating a directional sound environment, the method comprising:

providing a device including:

a headgear unit;

a pinna on an outer surface of the headgear unit, wherein the pinna approximates the shape of a human pinna;

a microphone positioned adjacent the pinna; and a speaker positioned on an interior of the headgear unit;

detecting a sound signal from the microphone; and generating sound inside the headgear unit from the speaker;

wherein the pinna has a filtering surface and serves as an analog filter to provide filtered sound to the microphone, the filtered sound being a representation of natural hearing approximating hearing cues a wearer of the headgear unit would receive naturally with the unaided ear when not wearing the headgear unit.

18. The method of claim 17 wherein the headgear unit includes a plurality of microphones thereon, the method including:

detecting a sound signal from the plurality of microphones; and applying a transfer function to the sound signal to provide a transformed sound signal, the transformed sound signal providing an approximation of free field hearing sound at a subject's ear inside the headgear unit.

19. The method of claim 18, wherein the transfer function is based on an experimentally determined propagation effect from sound propagating to an opening of an ear canal and substantially omitting propagation interference from the headgear unit.

20. The method of claim 18, further comprising generating sound inside the headgear unit responsive to the transformed sound signal.

21. The method of claim 18, wherein the headgear unit comprises a protective helmet.

22. The method of claim 18, wherein the plurality of microphones are positioned at locations on the headgear unit, the locations being selected to provide sufficient sound information to provide an approximation of free field hearing sound.

23. The method of claim 18, wherein applying a transfer function further comprises reducing the amplitude of a portion of the sound signal if the amplitude is higher than a threshold level.

24. The method of claim 18, wherein applying a transfer function further comprises canceling the amplitude of portions of sound signals.

25. The method of claim 18, wherein the headgear unit is substantially sound-proof in a frequency range.

26. The method of claim 17, wherein the pinna has the shape of a human ear.

27. The method of claim 17, including an earphone including an in-ear portion, wherein the speaker is configured to generate sound through the in-ear portion.

28. The method of claim 17, wherein the pinna approximates the shape of an average human ear.

29. The method of claim 17, wherein the pinna approximates the shape of an ear of a specific individual intended to wear the headgear unit.

30. The method of claim 29, including an earphone including an in-ear portion, wherein the speaker is configured to generate sound through the in-ear portion.

31. The method of claim 29, including measuring the ear of the specific individual and producing the pinna as a replica of the ear of the individual.

32. The method of claim 29, including optically scanning the ear of the specific individual and producing the pinna as a replica of the ear of the individual.

33. The method of claim 17, wherein the device includes an earphone including an in-ear portion, the method including mounting the in-ear portion in a user's ear and generating sound from the speaker through the in-ear portion.

34. The method of claim 17 wherein the device further includes:

a second pinna on the outer surface of the headgear unit opposite the first pinna, wherein the pinna approximates the shape of a human pinna;

a second microphone positioned adjacent the second pinna; and a second speaker positioned in the interior of the headgear unit, wherein the second microphone is configured to receive a sound signal and the second speaker is configured to generate sound inside the headgear unit;

wherein the second pinna has a filtering surface and serves as an analog filter to provide filtered sound to the second microphone, the filtered sound being a representation of natural hearing approximating hearing cues a wearer of the headgear unit would receive naturally with the unaided ear when not wearing the headgear unit.

35. A method for generating a directional sound environment, the method comprising:

providing a device including:

a headgear unit;

a pinna on an outer surface of the headgear unit, wherein the pinna approximates the shape of a human ear, wherein the pinna approximates the shape of an ear of a specific individual intended to wear the headgear unit;

a microphone positioned adjacent the pinna; and a speaker positioned on an interior of the headgear unit;

detecting a sound signal from the microphone; and generating sound inside the headgear unit from the speaker; and measuring the ear of the specific individual and producing the pinna as a replica of the ear of the individual.

36. A method for generating a directional sound environment, the method comprising:

providing a device including:

a headgear unit;

a pinna on an outer surface of the headgear unit, wherein the pinna approximates the shape of a human ear, wherein the pinna approximates the shape of an ear of a specific individual intended to wear the headgear unit;

a microphone positioned adjacent the pinna; and a speaker positioned on an interior of the headgear unit;

detecting a sound signal from the microphone; and generating sound inside the headgear unit from the speaker; and optically scanning the ear of the specific individual and producing the pinna as a replica of the ear of the individual.

* * * * *